US007878094B2

(12) United States Patent
Lin

(10) Patent No.: US 7,878,094 B2
(45) Date of Patent: Feb. 1, 2011

(54) TOOL WITH EXTENDABLE HANDLE

(75) Inventor: Shu-Ching Lin, Ta-Ya Hsiang (TW)

(73) Assignee: Stanley Black & Decker, Inc., New Britain, CT (US)

( * ) Notice: Subject to any disclaimer, the term of this patent is extended or adjusted under 35 U.S.C. 154(b) by 105 days.

(21) Appl. No.: 11/905,788

(22) Filed: Oct. 4, 2007

(65) Prior Publication Data

US 2009/0090224 A1 Apr. 9, 2009

(51) Int. Cl.
*B25B 23/16* (2006.01)

(52) U.S. Cl. ..... 81/177.2; 81/60; 403/109.3

(58) Field of Classification Search ..... 81/177.2, 81/177.1, 60–63.1; 16/429; 403/109.1–109.3, 403/109.6–109.8
See application file for complete search history.

(56) References Cited

U.S. PATENT DOCUMENTS

| | | | | |
|---|---|---|---|---|
| 2,592,978 | A | 4/1952 | Trimboli | |
| 2,963,930 | A | 12/1960 | Clothier et al. | |
| 3,227,015 | A * | 1/1966 | Tremblay | 81/177.2 |
| 3,306,639 | A | 2/1967 | Lyon | |
| 4,581,958 | A | 4/1986 | Shull | |
| 4,586,406 | A | 5/1986 | Howard | |
| 5,109,737 | A | 5/1992 | Raber | |
| 5,138,911 | A | 8/1992 | Lan | |
| 5,363,727 | A | 11/1994 | Barth et al. | |
| 5,471,899 | A | 12/1995 | Twomlow | |
| 6,006,634 | A | 12/1999 | Byers | |
| 6,182,539 | B1 | 2/2001 | Webster | |
| 6,408,721 | B1 | 6/2002 | Lee | |
| 6,761,094 | B2 | 7/2004 | Tobako | |
| D495,224 | S | 8/2004 | Videgain, Jr. et al. | |
| 6,959,629 | B2 | 11/2005 | Hsien | |
| 7,013,765 | B2 | 3/2006 | Chang | |
| 7,093,521 | B2 | 8/2006 | Lee | |
| 7,121,170 | B2 | 10/2006 | Shen | |
| 7,434,495 | B2 * | 10/2008 | Lin | 81/177.2 |
| 2003/0154826 | A1 | 8/2003 | Lee | |
| 2004/0020331 | A1 | 2/2004 | Lee | |
| 2005/0252347 | A1 | 11/2005 | Austin et al. | |
| 2006/0060033 | A1 | 3/2006 | Warner et al. | |
| 2006/0191384 | A1 | 8/2006 | Dougherty | |
| 2007/0017321 | A1 | 1/2007 | Doney | |

* cited by examiner

*Primary Examiner*—Hadi Shakeri
(74) *Attorney, Agent, or Firm*—Pillsbury Winthrop Shaw Pittman LLP

(57) ABSTRACT

A tool includes a working tool portion and an extendable handle joined with the working tool portion. The extendable handle includes a shaft, a tube, and an anti-rotation member that is unbiased so as to prevent, during application of relative rotational force between the shaft and tube, relative rotation between the shaft and tube and to prevent removal of a portion of the anti-rotation member from an axially arranged groove. A lock device is movable from a first position to a second position wherein when the lock device is in the first position the tube is prevented from moving axially relative to the shaft and wherein when the lock device is in the second position the tube can be moved axially relative to the shaft.

16 Claims, 6 Drawing Sheets

TOOL WITH EXTENDABLE HANDLE

BACKGROUND

Tools with extendable handles are known in the art. In particular, extendable wrench handles are known in the art, as illustrated by U.S. Pat. No. 6,408,721 ("the '721 patent"). For the same amount of exertion, a user can increase the amount of torque applied by the wrench to a nut or bolt by extending the handle of the wrench to increase the moment arm. Therefore, a user can loosen or tighten nuts or bolts more easily.

The tool disclosed by the '721 patent suffers from certain deficiencies. For example, it will not prevent relative rotation between the tube and shaft when sufficient relative rotational force between the tube and the shaft is applied. This can be a problem because a user may attempt to exert a purely translational force on the handle but instead some of this force may be transferred to a rotational force. This tool (and a similar tool disclosed by Published U.S. Patent Application 2004/0020331) also does not prevent the tube from becoming separated from the shaft when a large amount of torque is applied to the tube.

SUMMARY OF THE INVENTION

One embodiment of the invention relates to a tool. The tool includes a working tool portion and an extendable handle. The extendable handle is connected with the working tool portion. The extendable handle includes a number of components including a shaft, a tube, an anti-rotation member, and a lock device. A number of circumferential grooves are formed on the shaft. The tube is mounted on the shaft such that it can be slid along the shaft. The anti-rotation member can be carried by either the shaft or the tube. On the component that does not carry the anti-rotation member, an axially arranged groove is formed thereon. At least a portion of the anti-rotation member is received by the axially arranged groove. The anti-rotation member is unbiased and, during application of relative rotational force between the shaft and the tube, it prevents the tube from rotating relative to the shaft. The portion of the anti-rotation member that is received by the axially arranged groove is also prevented from coming out of the groove during application of relative rotational force between the shaft and the tube. The lock device is movable from a first position to a second position. When the lock device is in the first position, the lock device engages one of the circumferential grooves, preventing the tube from moving axially relative to the shaft. The tube can be moved axially relative to the shaft when the lock device is moved to the second position.

Another embodiment of the invention relates to an extendable handle. The extendable handle includes a number of components including a shaft, a tube, an anti-rotation member, and a lock device. A number of circumferential grooves are formed on the shaft. The tube is mounted on the shaft such that it can be slid along the shaft. The anti-rotation member can be carried by either the shaft or the tube. On the component that does not carry the anti-rotation member, an axially arranged groove is formed thereon. At least a portion of the anti-rotation member is received by the axially arranged groove. The anti-rotation member is unbiased and, during application of relative rotational force between the shaft and the tube, it prevents the tube from rotating relative to the shaft. The portion of the anti-rotation member that is received by the axially arranged groove is also prevented from coming out of the groove during application of relative rotational force between the shaft and the tube. The lock device is movable from a first position to a second position. When the lock device is in the first position, the lock device engages one of the circumferential grooves, preventing the tube from moving axially relative to the shaft. The tube can be moved axially relative to the shaft when the lock device is moved to the second position.

Another embodiment of the invention is an extendable handle. The extendable handle includes a shaft, a tube, an anti-rotation member, and a lock device. The shaft has a proximal end and a distal end, has an axially arranged groove, and has a number of circumferential grooves. The tube is mounted on the shaft such that it can be slid along the shaft. The tube carries the anti-rotation member. At least a portion of the anti-rotation member is received by the axially arranged groove, such that, during application of relative rotational force between the shaft and the tube, the anti-rotation member prevents the tube from rotating relative to the shaft. The portion of the anti-rotation member that is received by the axially arranged groove is also prevented from coming out of the groove during application of relative rotational force between the shaft and the tube. The lock device is movable from a first position to a second position. When the lock device is in the first position, the lock device engages one of the circumferential grooves, preventing the tube from moving axially relative to the shaft. The tube can be moved axially relative to the shaft when the lock device is moved to the second position.

Another embodiment of the invention is an extendable handle kit. The kit includes a shaft, a tube, an anti-rotation member, a lock device, and a stop member. The shaft has a proximal end and a distal end, has an axially arranged groove, and has a number of circumferential grooves. The tube has a proximal end and a distal end and an aperture is located near the distal end. The lock device is carried by the distal end of the tube. The proximal end of the shaft can be inserted into the distal end of the tube. By aligning the aperture with the axially arranged groove, the anti-rotation member can be inserted into the aperture such that a portion of the anti-rotation member extends into the axially arranged groove. As inserted, the anti-rotation member prevents the shaft from rotating relative to the tube when a rotational force is applied to the tube. The anti-rotation member also prevents the tube from separating from the shaft by engaging with the stop member when the distal end of the tube is moved towards the proximal end of the shaft. The lock device is movable from a first position to a second position. When the lock device is in the first position, the lock device engages one of the circumferential grooves, preventing the tube from moving axially relative to the shaft. The tube can be moved axially relative to the shaft when the lock device is moved to the second position.

Further benefits and advantages of the invention will become apparent from the following detailed description with appropriate reference to the accompanying drawings.

DETAILED DESCRIPTION OF THE INVENTION

Figure 1:
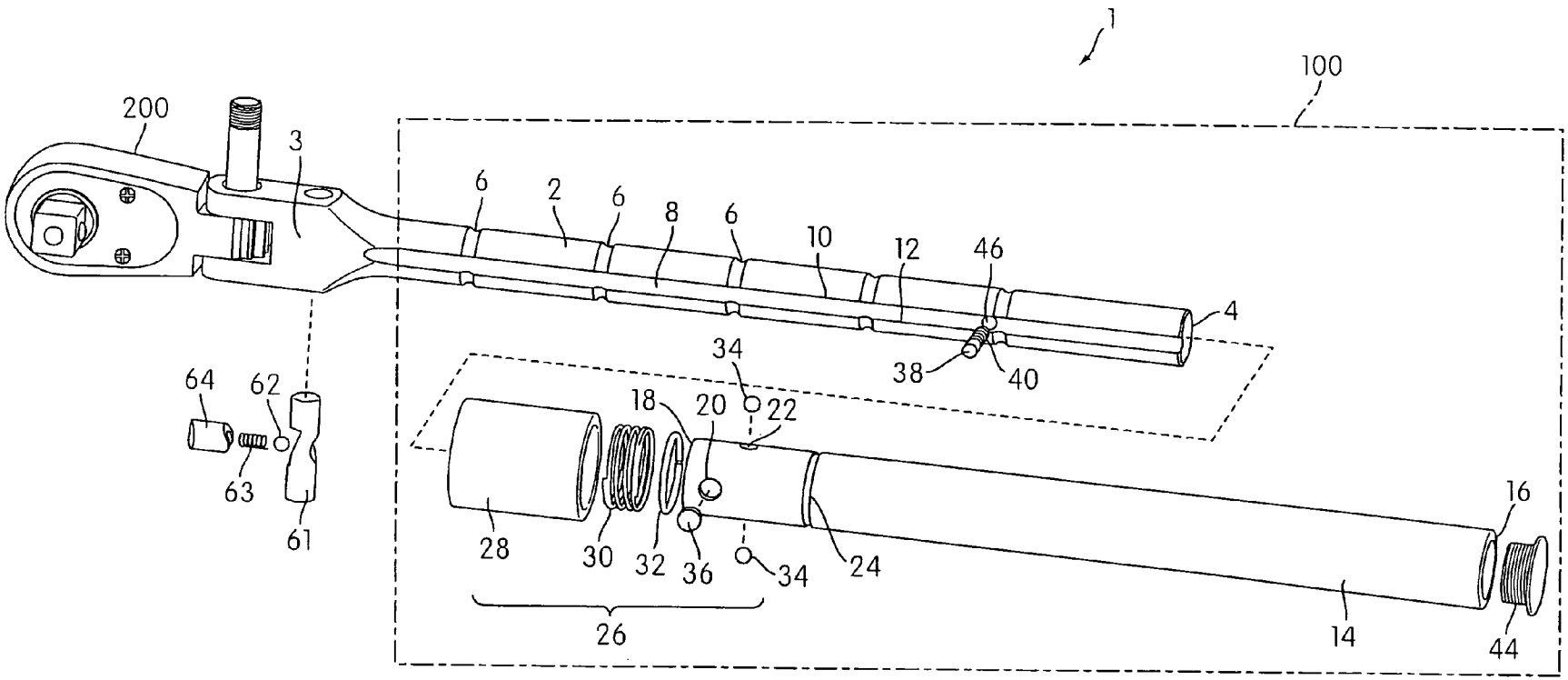
FIG. 1 is an exploded view of a tool with an extendable handle in accordance with one embodiment of the invention.

FIG. 1 shows an exploded view of a tool 1 having an extendable handle 100 and a working tool portion 200 in accordance with one embodiment of the invention. Extendable handle 100 comprises shaft 2, tube 14, lock device 26, and anti-rotation member 36. Tube 14 is slidably mounted on shaft 2. Tube 14 can be moved axially along shaft 2 to vary the length of the handle. Working tool portion 200 is joined with the distal end of extendable handle 100, and particularly, at the distal end 3 of shaft 2.

Shaft 2 comprises the distal end 3, proximal end 4, a plurality of circumferential grooves 6, axially arranged groove 8, and aperture 46. Tube 14 comprises distal end 18 and proximal end 16. Tube 14 also comprises anti-rotation aperture 20 which receives anti-rotation member 36. Tube 14 also comprises lock apertures 22 for receiving a portion of lock device 26 as will be described. Tube 14 also comprises external circumferential groove 24 for receiving another portion of lock device 26 as will be described.

Extendable handle 100 also comprises stop member 38 outwardly biased by spring 40 and received into aperture 46 formed in axially arranged groove 8. Extendable handle 100 also comprises end cap 44 which covers proximal end 16 of tube 14. Lock device 26 comprises lock members 34, collar 28, compression spring 30, and c-ring 32.

Figure 2:
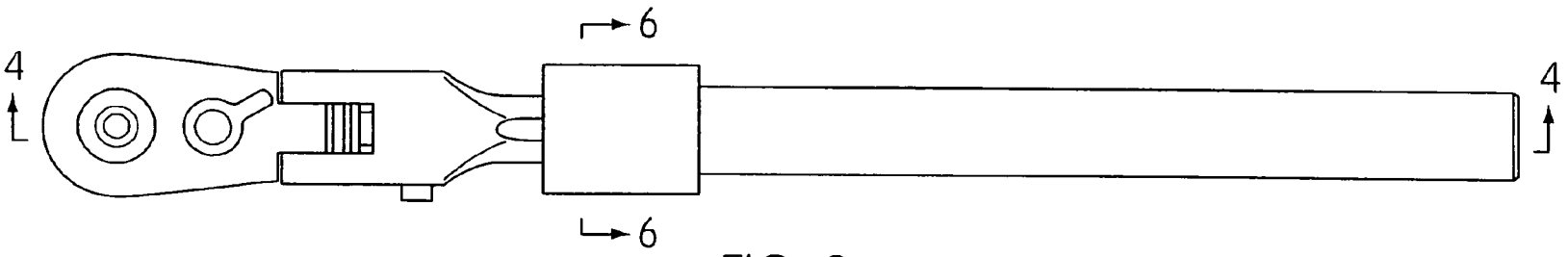
FIG. 2 is a top view of a tool with an extendable handle in accordance with one embodiment of the invention.
Figure 3:
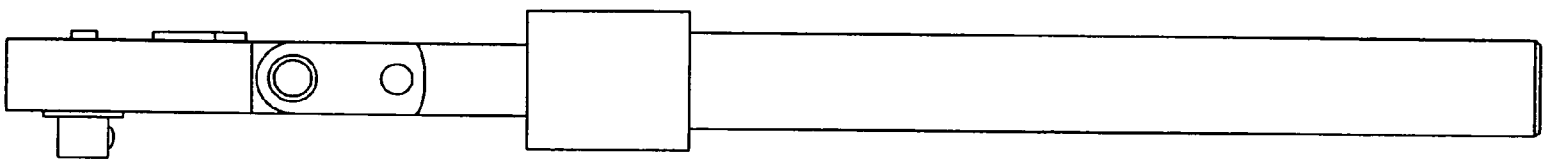
FIG. 3. is a cross sectional view along the length of the extendable handle of a tool with an extendable handle in accordance with one embodiment of the invention.

FIG. 2 shows a top view of the assembled tool 1 having the extendable handle 100 shown in FIG. 1, in accordance with one embodiment of the invention. Referring to FIG. 3, a side view of FIG. 2 is shown. As can be seen in FIG. 3, aperture 46 extends a portion of the way through shaft 1 to receive spring 40 in order to outwardly bias stop member 38. This positions stop member 38 to extend into the axially arranged groove 8.

Figure 4:
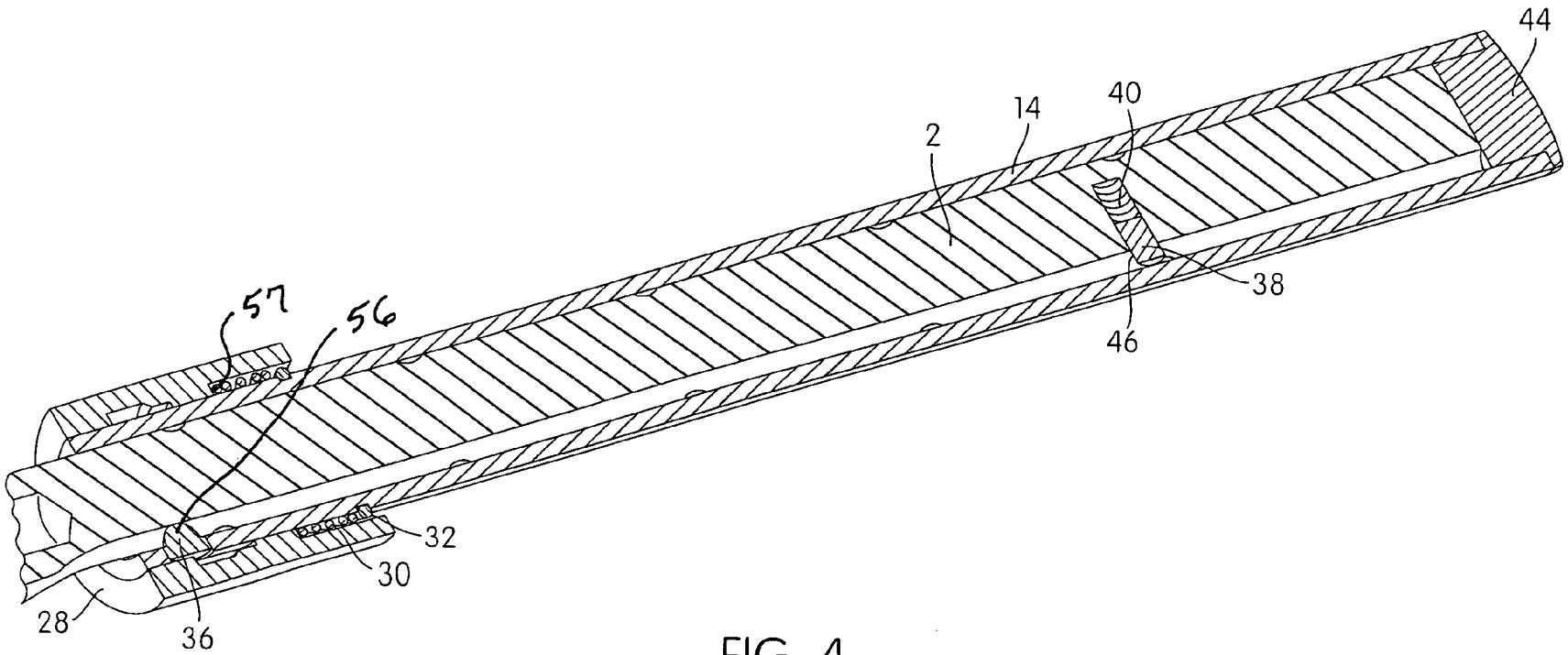
FIG. 4. is a view of a portion of the cross sectional view of the extendable handle shown in FIG. 3 in accordance with one embodiment of the invention.

Referring to FIG. 4, the proximal end of the tool 1 shown in FIG. 3 is provided. Lock collar 28 is shown fitting around tube 14, which surrounds shaft 2. The anti-rotation member 36, in one embodiment, comprises a projection formed on the tube 14. For example, the projection may be formed by first drilling or otherwise forming the hole 20 in the tube 14, and subsequently fixing (e.g., by welding, soldering, bolting, adhering, threaded connection) the projecting anti-rotation member 36 to the edge surrounding the hole 20. A projecting portion 56 of anti-rotation member 36 fits into the longitudinally arranged groove 8 formed in a side of shaft 2. This engagement of anti-rotation member 36 in groove 8 prevents tube 14 from rotating relative to shaft 2. Lock device 26 is also shown assembled.

Lock device 26 is movable from a first position to a second position. Each lock member 34 is received within an associated lock aperture 22 formed in tube 14 (see FIG. 1). Referring again to FIG. 4, when lock device 26 is in the first position, lock member 34 engages within one of the circumferential grooves 6 in shaft 2 and prevents relative axial movement between tube 14 and shaft 2. In one embodiment, the lock members 34 comprise locking balls, as shown most clearly in FIG. 5B.

Collar 28 comprises lock section 48, unlock section 50, and transition section 52. Lock section 48 comprises a smaller inner diameter than unlock section 50. In the first position, lock section 48 is longitudinally or axially aligned with lock members 34 so that the lock members 34 are retained in contact within the circumferential grooves 6. Compression spring 30 normally holds collar 28 in this locked position. As shown, a spring 30 is received in a recess 54 formed in collar 28, and one end of compression spring 30 is connected to (or engaged with) tube 14 at external groove 24 by c-ring 32. The c-ring 32 essentially operates as a stop or bearing surface for one end of the spring 30. Also shown in FIG. 4, the other end of compression spring 30 bears against an outwardly projecting surface 57 formed on the collar 28.

When lock device 26 is moved to the second position, the unlock section 50 is longitudinally or axially aligned with lock members 34 so that the lock members 34 can move out from engagement with the grooves 6 to enable relative axial movement between the tube 14 and shaft 2. A user can then move tube 14 until lock member 34 is lined up with the desired circumferential groove 6. The user can then move lock device 26 back to the first position into order to force lock members 34 into engagement with the desired circumferential groove 6.

Looking at FIG. 4 in more detail, in order to adjust the length of extendable handle 100, a user forces collar 28 towards proximal end 16 of tube 14. This action compresses spring 30 and relieves the pressure of lock section 48 on lock members 34. As collar 28 is moved against the spring bias, lock members 34 enter unlock section 50 of collar 28. In this position, there is no longer any force against lock members 34 and the user can slide tube 14 along shaft 2 to the desired position. If the user moves lock device 26 to a position such that lock members 34 are in between two circumferential grooves 6, and the collar 28 is manually released, the user can slide tube 14 axially in either direction to the desired circumferential groove 6. When tube 14 is slid along shaft 2 such that lock members 34 align with circumferential groove 6, lock members 34 fall into one of the circumferential grooves 6 and compression spring 30 extends to push collar 28 towards distal end 18 of tube 14 such that lock members 34 are forced against transition section 52 and slides into lock section 48 of collar 28 and lock section 48 forces lock members 34 against the selected circumferential groove 6 to lock extendable handle 100 into the desired length.

Thus, a user can easily adjust the length of extendable handle 100. For example, in one embodiment working tool portion 200 comprises a ratchet. In this embodiment, a user could be using tool 1 with extendable tool handle 100 to tighten a bolt. The user may desire to apply more torque to the bolt. The user could simply hold working tool portion 200 with one hand and pull collar 28 back with the other hand. The user could then slide tube 14 along shaft 2 to a desired position until lock member 34 locks into one of circumferential grooves 6. The user could then continue tightening the bolt and utilize the increased torque arm.

Figure 5A:
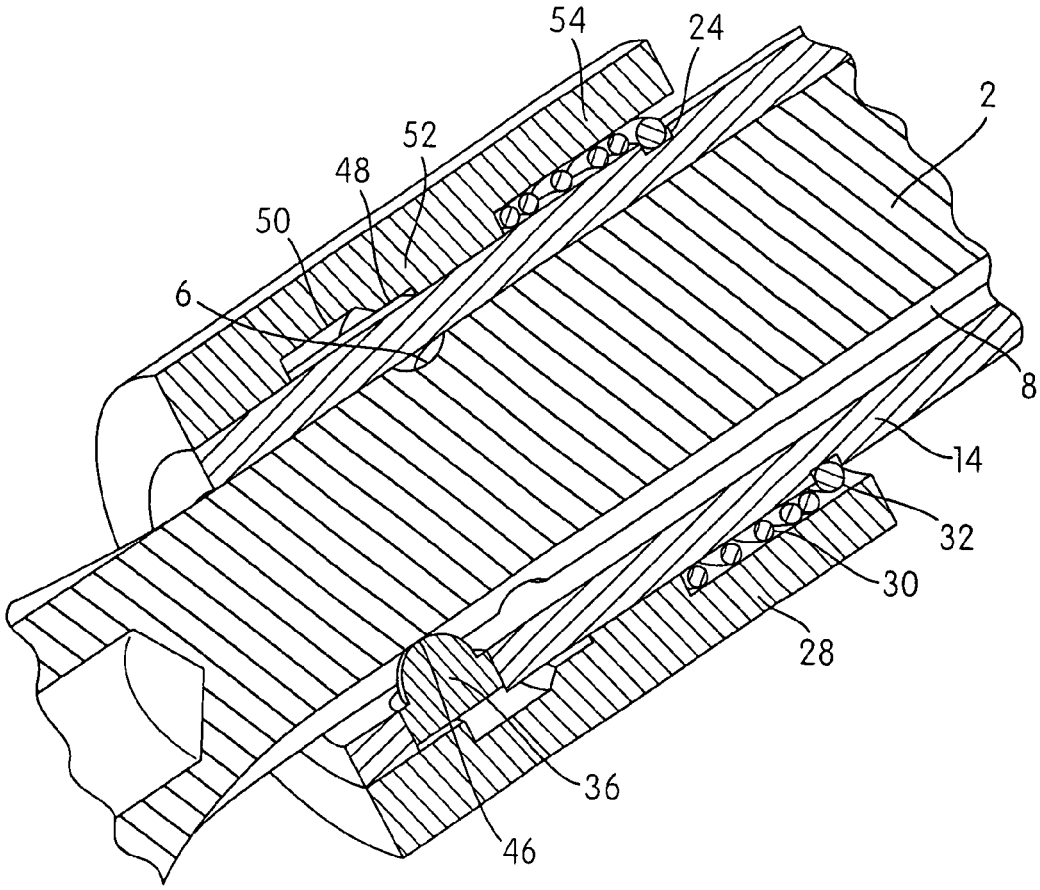
FIG. 5A. is a cross sectional of the extendable handle of a tool with an extendable handle in accordance with one embodiment of the invention, and showing the anti-rotation member.
Figure 5B:
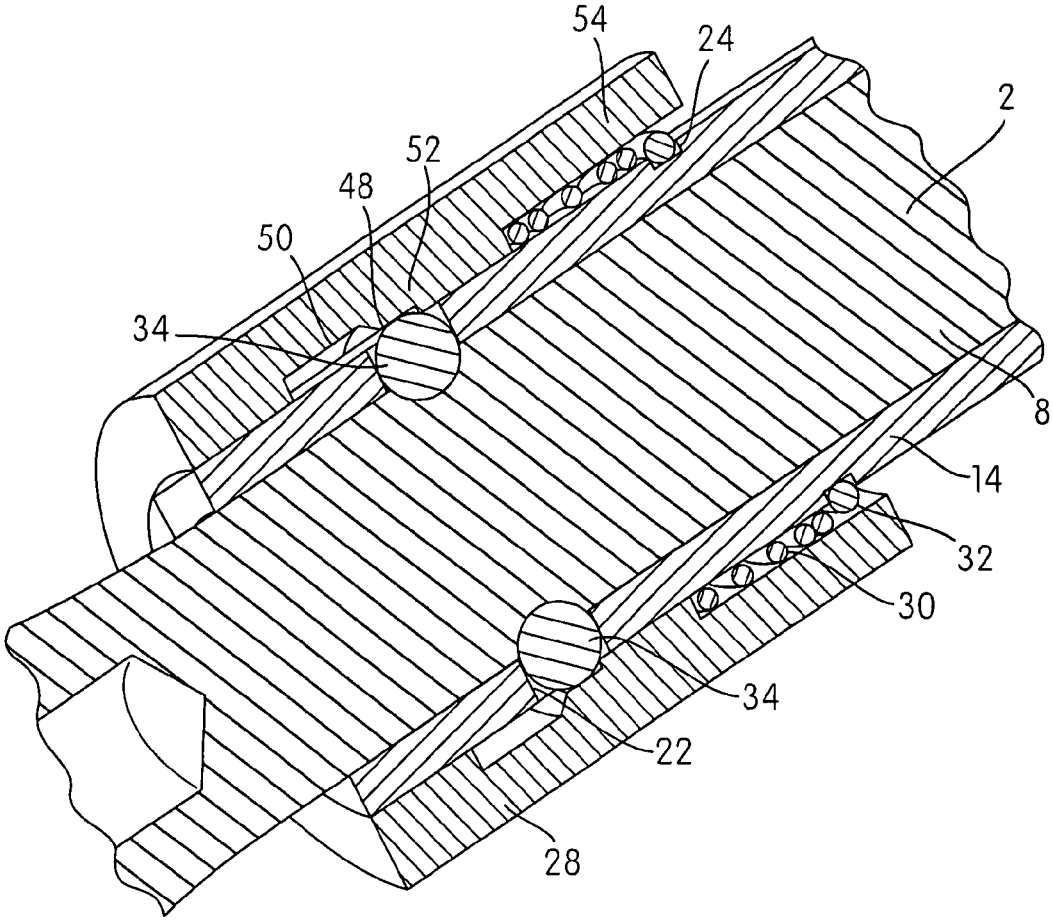
FIG. 5B. is a cross sectional of the extendable handle of a tool with an extendable handle in accordance with one embodiment of the invention, and showing a lock member in the form of a locking ball.
Figure 6:
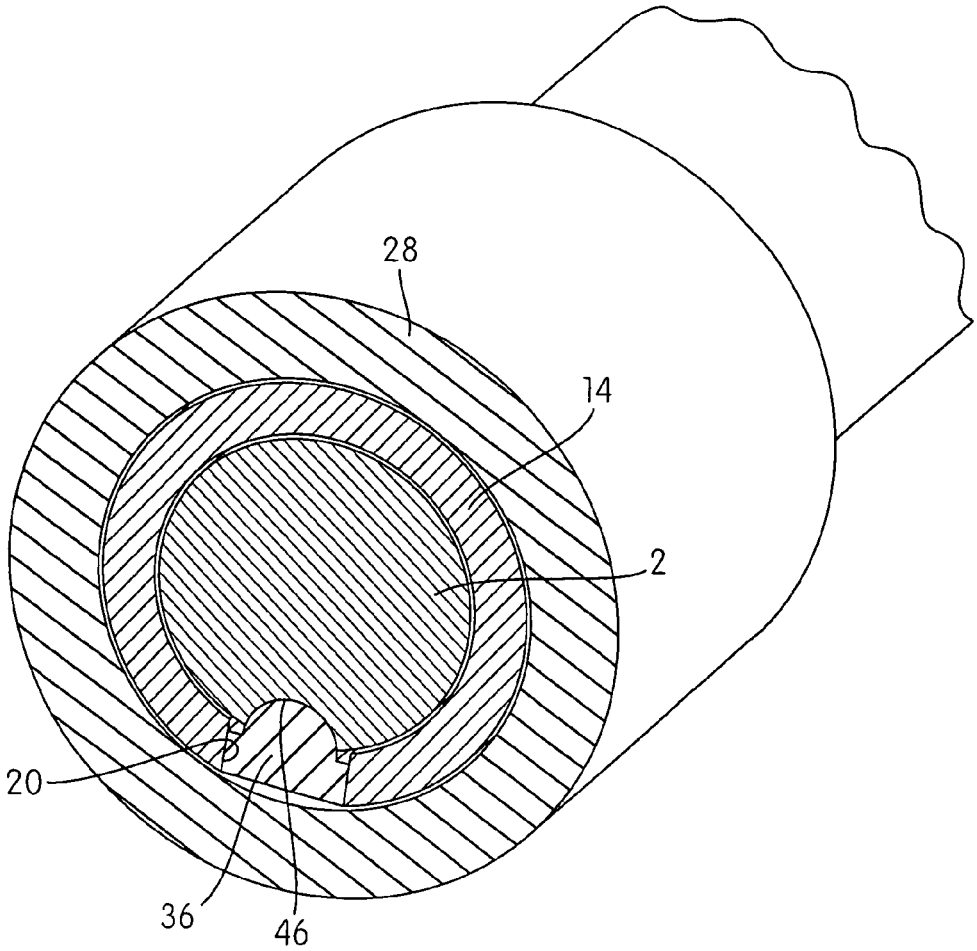
FIG. 6 is a cross-sectional view taken through the line 6-6 in FIG. 2.

In the embodiment shown in the figures, anti-rotation member 36 is carried by tube 14. In this embodiment, shaft 2 includes axially arranged groove 8. Referring to FIGS. 5A and 6, at least a portion 46 of anti-rotation member 36 is received within axially arranged groove 8. Anti-rotation member 36 prevents relative rotation between tube 14 and shaft 2 when relative rotational force is applied between tube 14 and shaft 2. However, in another embodiment, anti-rotation member 36 may be carried by shaft 2. In this embodiment, tube 14 includes an axially arranged groove formed on the inner surface. At least a portion of an anti-rotation member would be received within axially arranged groove.

In one embodiment, extendable handle 100 further comprises stop member 38. As best illustrated in FIG. 3, stop member 38 engages anti-rotation member 36 to prevent tube 14 from becoming separated from shaft 2 when extendable handle 100 is fully extended. In the embodiment shown in the figures, stop member 38 is carried by shaft 2. In another embodiment, stop member 38 can be carried by tube 14.

In the embodiment shown in the figures, anti-rotation member 36 is unbiased. As such, anti-rotation member 36 will not come out of axially arranged groove 8 under application of force during operation (i.e., at operational forces). Moreover, because anti-rotation member 36 will engage stop member 38 when tube 14 is moved proximally, tube 14 is prevented from separating from shaft 2, even under extreme torque. Thus, tool 1 with extendable handle 100 can be used safely.

Shaft 2 can be formed from any suitable material such as a high carbon stainless steel. In one embodiment, circumferential grooves 6 extend only partially around the circumference of shaft 2. In another embodiment, circumferential grooves 6 are complete circles. Circumferential grooves 6 can be formed by any suitable method such as milling, lathing, or laser incision. In one embodiment, circumferential grooves 6 are evenly spaced along the length of shaft 2. In another embodiment, the spacing between the circumferential grooves 6 varies. In the embodiment in which shaft 2 comprises axially arranged groove 8, axially arranged groove 8 can be formed before or after circumferential grooves 6. Circumferential grooves 6 and axially arranged groove 8 can be formed to the same depth or different depths. In one embodiment, axially arranged groove 8 is formed deeper than circumferential grooves 6 and circumferential grooves 6 extend from one edge 10 of axially arranged groove 8 to the other edge 12. Thus, anti-rotation member 36 is prevented from rotating into one of circumferential grooves 6. This is best illustrated in FIG. 1.

Tube 14 can be formed from any suitable material such as stainless steel. In one embodiment, end cap 44 covers proximal end 16 of tube 2 to prevent contamination and dirt from entering within tube 14. In one embodiment, tube 14 comprises a plurality of lock apertures 22 formed equidistance from distal end 18 of tube 14. In the embodiment shown in the figures, tube 14 comprises two diametrically opposed lock apertures 22 formed equidistant from distal end 18 of tube 14. In another embodiment, tube 14 comprises a single lock aperture 22. Lock apertures 22 receive lock member 34 of lock device 26 to allow lock member 34 to engage with one of circumferential grooves 6 when lock device 26 is moved to the first position.

In the embodiment shown in the figures, as discussed above, tube 14 comprises anti-rotation aperture 20 formed near distal end 18 of tube 14. Anti-rotation aperture 20 is adapted to receive anti-rotation member 36. In one embodiment, anti-rotation aperture 20 is threaded and anti-rotation member 36 is a pin having a threaded section. In this embodiment, anti-rotation member 36 can be screwed into the anti-rotation aperture 20 to extend into axially arranged groove 8 and thereby prevent relative rotation between tube 14 and shaft 2.

In the embodiment shown in the figures, tube 14 is prevented from separating from shaft 2 by engagement between anti-rotation member 36 and stop member 38. In this embodiment, when extendable handle 100 is extended to its maximum length by axially moving distal end 18 of tube 14 towards proximal end 4 of shaft 2, anti-rotation member 36 engages stop member 38 and prevents any further axial movement. Referring to FIG. 3, in one embodiment, stop member 38 is biased by spring 40 positioned inside aperture 46 formed in axially arranged groove 8.

In one embodiment, the tube 14 may be removed from shaft 2. In such an embodiment, anti-rotation member 36 can be removed such as by unscrewing it. In this case, a hole would be provided in collar 28 to permit access to member 36.

In another embodiment, anti-rotation member 36 comprises a key. For example, in one embodiment in which anti-rotation member 36 is carried by shaft 2, anti-rotation member 36 may comprise a key section extending from the surface of shaft 2. This key section may extend along the entire length of shaft 2 or only along a portion of shaft 2. In general, the shape or configuration of anti-rotation member 36 is not limited. Any suitable shape or configuration may be used that can engage axially arranged groove 8 to prevent rotation. The shape of axially arranged groove 8 is also not limited. The cross section of axially arranged groove may be rectangular shaped, circular shaped, or of any other shape. Anti-rotation member 36 may be removable or fixedly attached.

As noted above, in one embodiment, lock members 34 comprise balls. In another embodiment, lock members 34 comprises cylinders. In general, lock members 34 are not limited to a particular shape or configuration. Lock members 34 can be formed from any suitable material such as steel. While two lock members 34 are shown, only a single lock member 34 may be used.

In one embodiment that provides a removable anti-rotation member 36 (e.g., threaded connection with aperture 20), in addition to being able to easily adjust the length of extendable handle 100, a user can also easily disassemble tool 1 with extendable handle 100 in order to clean it, replace a part, or perform other maintenance. Referring again to FIG. 4, in order to disassemble tool 1 a user would first pull collar 28 towards proximal end 16 of tube 14. This action would expose anti-rotation member 36 through a hole that can be provided in collar 28 (not shown). The user could then remove anti-rotation member 36 from anti-rotation aperture 20. The user can then slide tube 14 off of shaft 2. The user could also remove collar 28 from tube 14 by popping c-spring 32 out of external groove 24 of tube 14.

Extendable handle 100 can be used with any working tool portion 200. Exemplary working tool portions include wrench bodies, ratchet mechanisms, screw driver heads, drill bits, hammer heads, Allen wrench heads, and the like. In the embodiment illustrated in the figures, the working tool portion 200 is a ratchet wrench head. In the embodiment illustrated in FIG. 1, the head 200 is pivotally connected to the handle 100 by a pivot pin (not labeled with a reference number). The pivoting action can be locked or released by a release button 61, which cooperates with a locking ball 62, a spring 63, and a lock member 64, as known in the art.

Although shown as cylinders, shaft 2 and tube 14 can be of any complimentary shape. Further although circumferential grooves 6 are shown as single continuous grooves, circumferential grooves 6 are not limited to such. For example, circumferential grooves 6 could consist of individual semi-circular recesses to receive lock members 34 or as partial disconnected circumferential grooves.

In the embodiment shown in the figures, stop member 38 comprises a spring biased removable pin. In another embodiment, stop member 38 comprises any raised surface compared to the trough of axially arranged groove 8. In general, stop member 38 is not limited to any shape or configuration.

Although certain embodiments have been explained in detail in order to demonstrate the invention, the invention is not limited in anyway to these embodiments. It is understood that the invention includes various modifications and arrangements that are different from those shown or described. Therefore, the scope of the invention should only be limited by the appended claims and their equivalents.

What is claimed is:

1. A tool comprising:

a working tool portion; and an extendable handle joined with the working tool portion, the extendable handle comprising:

a shaft comprising a plurality of circumferential grooves;

a tube slidably mounted on the shaft, the tube forming an opening in the wall thereof;

an anti-rotation member carried within the opening in the wall of the tube, and having at least a portion thereof received within an axially arranged groove disposed on the shaft, wherein the anti-rotation member is disposed in the opening in the wall of the tube and in the axially arranged groove on the shaft so as to prevent, during application of relative rotational force between the shaft and tube, relative rotation between the shaft and tube;

a stop member carried by the shaft wherein the stop member engages the anti-rotation member to prevent the tube from separating from the shaft when the tube is moved axially relative to the shaft to a maximum distance, wherein one end of the stop member is received within an aperture formed in the shaft and the other end of the stop member extends radially outward from the surface of the axially arranged groove; and a lock device comprising a collar slidably mounted on the tube, wherein the collar is movable from a first position to a second position wherein when the collar is in the first position the tube is prevented from moving axially relative to the shaft by engagement of the lock device with one of the plurality of circumferential grooves, wherein when the collar is in the second position the tube can be moved axially relative to the shaft, and wherein the collar is mounted on the tube such that in each of the first position and the second position the collar covers the opening in the tube to prevent the portion of the anti-rotation member in the axially arranged groove from being removed from the axially arranged groove.

2. The tool of claim 1, wherein the circumferential grooves of the shaft of the extendable handle extend only partly around the circumference of the shaft.

3. The tool of claim 1, wherein the axially arranged groove has two edges and wherein each of the circumferential grooves extends from one edge of the axially arranged groove to the other edge of the axially arranged groove.

4. The tool of claim 1, wherein the anti-rotation member of the extendable handle comprises a pin.

5. The tool of claim 1, wherein the stop member comprises a pin.

6. The tool of claim 5, wherein the stop member is biased.

7. The tool of claim of claim 1, wherein the shaft of the extendable handle comprises a distal end and a proximal end and wherein the stop member is located near the proximal end of the shaft.

8. The tool of claim 1, wherein the shaft of the extendable handle comprises a distal end and a proximal end and wherein the working tool portion is carried by the shaft near the distal end.

9. The tool of claim 8, wherein the working tool portion comprises a ratchet mechanism.

10. The tool of claim 1, wherein the tube of the extendable handle comprises a distal end and a proximal end and wherein an end cap covers the proximal end.

11. The tool of claim 1, wherein the tube of the extendable handle comprises a distal end and a proximal end and wherein the lock device is removably connected to the tube near the distal end thereof.

12. The tool of claim 1, wherein the lock device of the extendable handle comprises at least one lock member wherein when the lock device is in the first position the at least one lock member engages one of the circumferential grooves.

13. The tool of claim 12, wherein the tube of the extendable handle further comprises two diametrically opposed apertures wherein a lock member is received within each diametrically opposed aperture.

14. An extendable handle comprising:

a shaft comprising a plurality of circumferential grooves;

a tube slidably mounted on the shaft, the tube forming an opening in the wall thereof;

an anti-rotation member carried within the opening in the wall of the tube, and having at least a portion thereof received within an axially arranged groove disposed on the shaft, wherein the anti-rotation member is disposed in the opening in the wall of the tube and in the axially arranged groove on the shaft so as to prevent, during application of relative rotational force between the shaft and tube, relative rotation between the shaft and tube;

a stop member carried by the shaft wherein the stop member engages the anti-rotation member to prevent the tube from separating from the shaft when the tube is moved axially relative to the shaft to a maximum distance, wherein one end of the stop member is received within an aperture formed in the shaft and the other end of the stop member extends radially outward from the surface of the axially arranged groove; and a lock device comprising a collar slidably mounted on the tube, wherein the collar is movable from a first position to a second position wherein when the collar is in the first position the tube is prevented from moving axially relative to the shaft by engagement of the lock device with one of the plurality of circumferential grooves, wherein when the collar is in the second position the tube can be moved axially relative to the shaft, and wherein the collar is mounted on the tube such that in each of the first position and the second position the collar covers the opening in the tube to prevent the portion of the anti-rotation member in the axially arranged groove from being removed from the axially arranged groove.

15. An extendable handle comprising:

a shaft comprising:

a proximal end;

a distal end;

an axially arranged groove that runs from at or near the proximal end to at or near the distal end;

a plurality of circumferential grooves that run transverse to the axially arranged groove; and a stop member carried by the shaft wherein one end of the stop member is received within an aperture formed in the shaft and the other end of the stop member extends radially outward from the surface of the axially arranged groove;

a tube slidably mounted on the shaft, the tube forming an opening in the wall thereof;

an anti-rotation member within the opening in the wall of the tube, and having at least a portion thereof received within the axially arranged groove, wherein, during application of relative rotational force between the shaft and tube, the anti-rotation member prevents relative rotation between the shaft and tube; wherein the stop member engages the anti-rotation member to prevent the tube from separating from the shaft when the tube is moved axially relative to the shaft to a maximum distance, and a lock device comprising a collar slidably mounted on the tube, wherein the collar is movable from a first position to a second position wherein when the collar is in the first position the tube is prevented from moving axially relative to the shaft by engagement of the lock device with one of the plurality of circumferential grooves, wherein when the collar is in the second position the tube can be moved axially relative to the shaft, and wherein the collar is mounted on the tube such that in each of the first position and the second position the collar covers the opening in the tube to prevent the portion of the anti-rotation member in the axially arranged groove from being removed from the axially arranged groove.

16. An extendable handle kit comprising:

a shaft comprising:

a proximal end;

a distal end;

an axially arranged groove that runs from at or near the proximal end to at or near the distal end; and a plurality of circumferential grooves that run transverse to the axially arranged groove;

a tube comprising:

a proximal end;

a distal end; and an aperture located near the distal end;

an anti-rotation member;

a lock device comprising a collar; and a stop member carried by the shaft wherein one end of the stop member is received within an aperture formed in the shaft and the other end of the stop member extends radially outward from the surface of the axially arranged groove, wherein the lock device is carried by the distal end of the tube, wherein the extendable handle kit can be assembled into an extendable handle by inserting the proximal end of the shaft into the distal end of the tube, aligning the aperture with the axially arranged groove, inserting the anti-rotation member into the aperture such that a portion thereof extends into the axially arranged groove, wherein as assembled the anti-rotation member prevents relative rotation between the shaft and tube during application of relative rotational force between the shaft and tube and prevents separation of the tube from the shaft by engagement with the stop member when the distal end of the tube is moved axially towards the proximal end of the shaft, wherein as assembled the collar of the lock device is slidably mounted on the distal end of the tube to move from a first position to a second position, wherein when the collar is in the first position the lock device engages one of the plurality of circumferential grooves to prevent relative axial movement between the tube and the shaft, wherein when the collar is in the second position the tube can be moved axially relative to the shaft, and wherein as assembled the collar is mounted on the tube such that in each of the first position and the second position the collar covers the aperture in the tube to prevent the portion of the anti-rotation member in the axially arranged groove from being removed from the axially arranged groove.

* * * * *